United States Patent [19]

MacFarlane et al.

[11] 4,015,310

[45] Apr. 5, 1977

[54] PENDANT FOR DRAPERY TRAVERSE ROD

[75] Inventors: Walter J. MacFarlane, Kensington; Dieter G. Koss, Middletown, both of Conn.

[73] Assignee: The Stanley Works, New Britain, Conn.

[22] Filed: Mar. 18, 1976

[21] Appl. No.: 668,282

[52] U.S. Cl. ..... 16/87.4 R; 24/201 HE

[51] Int. Cl.[2] ..... A47H 15/00

[58] Field of Search ..... 16/93 D, 87.4 R, 87.2; 24/201 HE, 201 HL, 225, 230.5 CR

[56] References Cited

UNITED STATES PATENTS

| | | | |
|---|---|---|---|
| 2,872,696 | 2/1959 | Perlmutter | 16/93 D X |
| 3,324,501 | 6/1967 | Lydard | 16/87.4 R |
| 3,829,928 | 8/1974 | Pizzurro | 16/87.2 |
| 3,881,218 | 5/1975 | Palmer | 16/93 D |

FOREIGN PATENTS OR APPLICATIONS

| | | | |
|---|---|---|---|
| 1,382,590 | 11/1964 | France | 16/93 D |
| 1,232,711 | 1/1967 | Germany | 16/87.2 |

*Primary Examiner*—Andrew V. Kundrat
*Attorney, Agent, or Firm*—Prutzman, Hayes, Kalb & Chilton

[57] ABSTRACT

This invention relates to drapery rods having pendants or hangers for supporting drapes or curtains and more particularly to pendants which incorporate means for facilitating the attachment of drapery hooks thereto and for preventing the accidental disengagement of hooks once they are attached.

8 Claims, 4 Drawing Figures

PENDANT FOR DRAPERY TRAVERSE ROD

A problem which has existed in the past with the support of drapes or curtains by traverse rods through the means of hooks is that hooks are prone to accidental disengagement when raised relatively to the supporting pendants or hangers during the course of hanging the drapes or curtains or when the drapes or curtains are thereafter disturbed as by someone brushing against them. As a result, the considerable inconvenience of rehooking a hook on a hanger has been necesary and special care exercised to prevent adjacent hooks from becoming disengaged during the lifting of the disengaged hook for rehooking the same thereby increasing the time and care required to hang a drape.

It is an object of this invention to provide a pendant for supporting a drapery hook which, after the drapery hook is initially engaged therewith, will prevent the hook from becoming inadvertently disengaged from the pendant.

It is another object of this invention to provide such a pendant which will facilitate the attachment of the hook to the pendant as well as prevent the accidental disengagement of hooks therefrom. Including in this object is the provision of such a pendant which is suitable for use with conventional drapery hooks and can be field-retrofitted on existing drapery traverse rods.

Other objects will be in part obvious and in part pointed out more in detail hereinafter.

A better understanding of the invention will be obtained from the following detailed description and the accompanying drawings. In the drawings.

Figure 1:
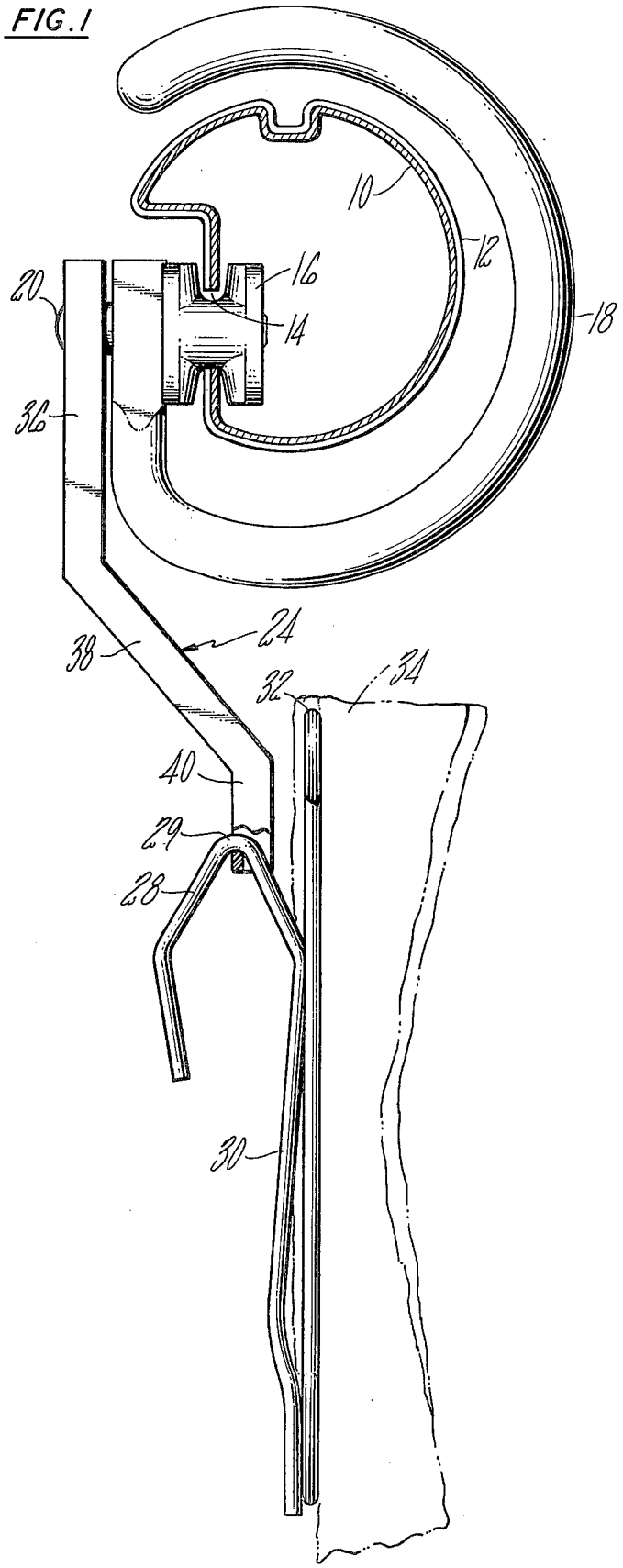
FIG. 1 is a cross-sectional end view of a drapery traverse rod incorporating a pendant or hanger illustrating a preferred form of the present invention.

Referring now to the drawings in detail, there is shown a preferred embodiment of the invention wherein a conventional telescoping traverse rod comprising telescoping sections 10 and 12 are provided. The traverse rod has a rear vertical wall forming a slot 14 extending the length of the rod. A slide 16 mounting a simulated ring 18 is shown as being mounted in the slot 14 for longitudinal movement therealong. The slide 16 is provided with a rearwardly extending projection 20 which is received within the aperture 22 of the pendant or hanger 24 to pivotally support the hanger.

The hanger 24 is provided with an eye 26 for receiving the reversely bent V-shaped end 28 of a conventional drapery hook 30 which provides a vertically disposed upstanding free end 32 suited to be received in a pocket in the heading of the drape 34 in a conventional manner.

Figure 4:
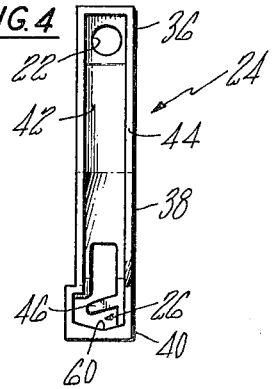
FIG. 4 is a rear view on a reduced scale showing the hanger of FIG. 1.

It is desirable that the weight of the drape 34 be supported by hanger 24 substantially in vertical alignment with the slot 14 of the traverse rod. To this end, the hanger 24 is provided with an upper vertically disposed section 36 attached to the slide 16, a forwardly bent intermediate depending section 38, and a vertical depending end portion 40. The hanger 24 is preferably molded from a suitable synthetic plastics material and, as best shown in FIG. 4, is provided with a rear central recess 42 surrounded by a reinforcing flange 44.

The eye 26 for receiving the end 28 of the hook 30 is enlarged and vertically elongated so as to extend upwardly into the angled intermediate portion 38 of the hanger to provide a large opening to make it easy to thread the end of the hook 28 into the eye 26 with the minimum amount of tilting of the hook 30. The eye 26 includes a cantilever mounted finger 46 which extends from the side wall 48 of the eye and downwardly and laterally across the eye 26. The opposite side wall of the eye has an upper vertical portion 50 and a lower laterally offset vertical portion 52 to provide a shoulder 54 which cooperates with finger 46 to provide a narrow throat 56 preferably having a dimension slightly less than the diameter of the hook 28. As a result, after insertion of the end of the hook 28 in the upper portion **26*a* of the eye 26, it is moved downwardly to its final position past finger 46 which it must deflect before it enters the lower portion 26*b* of the eye 26**.

Figure 2:
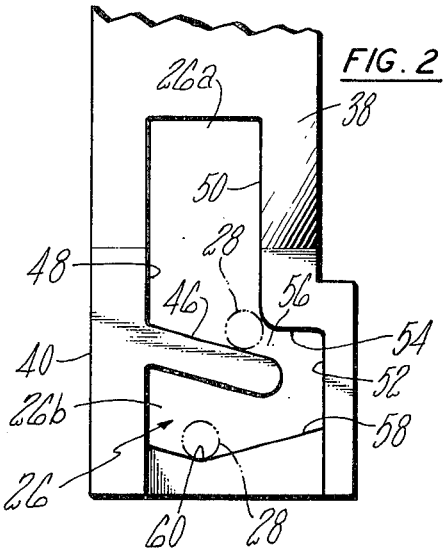
FIG. 2 is a fragmentary front elevation view of the hanger of FIG. 1.

As shown in FIG. 2, the finger 46 extends laterally so that its free end extends further laterally than the upper portion 50 of the side wall 52 of the hanger and cooperates with the eye 26 to form a serpentine path for the entry of the hook 28 into the eye 26.

The lower wall 58 of the eye which forms the supporting surface of the hanger is V-shaped with the apex 60 of the V being substantially along vertical centerline of hanger 24 and so that the hanger 24 will assume a vertical position when viewed from the front of the traverse rod.

Figure 3:
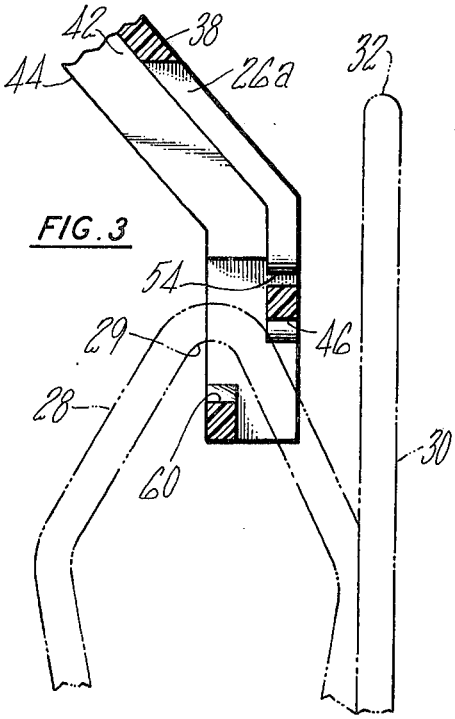
FIG. 3 is a fragmentary cross-sectional side elevational view of the hanger.

As best shown in FIGS. 1 and 3, the apex 60 of the bottom wall 58 is vertically offset to the rear of finger 46 so that the apex 29 of the hook 28 will be vertically offset to the rear of the finger 46. As a result, when the hook is lifted inadvertently or otherwise, it will be cammed by its own shape toward the rear of the finger 46 thereby to prevent disengagement despite the fact that the eye 26 is enlarged and extends up into the angled intermediate portion 38 of the hanger. Moreover, since the use of the finger 46 results in a serpentine path for the hook to follow in order to become disengaged from the hanger, as viewed in FIG. 2, the accidental disengagement of the hook from the eye is made further unlikely particularly since the bottom surface of the finger 46 is angled upwardly away from the throat 56 and the finger 46 overlies the apex 60. In addition, the narrow throat between the resilient finger 46 and the shoulder 54 is also effective in preventing the accidental disengagement of the hook from the hanger while by providing an enlarged eye which enables the hook to be more easily inserted.

From the foregoing, it is apparent that this invention provides a drapery pendant or hanger having an enlarged eye for the easy insertion of the hook into the hanger while at the same time providing a design wherein the accidental disengagement of the hook from the eye during hanging or use is minimized.

As will be apparent to persons skilled in the art, various modifications, adaptations and variations can be made from the foregoing specific disclosure without departing from the teachings of the present invention.

We claim:

1. For use with a drapery rod suited for supporting drapes and a conventional drapery hook having a reversely bent upper end provided with an apex attached to the drape heading thereof, a drapery hanger having an eye to receive the reversely bent end of the hook, said drapery hanger including means for attachment to the drapery rod extending from one face thereof and having a downwardly depending portion providing an enlarged eye to facilitate the insertion of the end of the hook, said eye having a top wall adjacent said one face of the hanger for facing the drape and a bottom wall adjacent the face of the hanger opposite said one face for facing away from the drape to provide a supporting surface for the apex of the reversely bent end of the hook, said supporting surface being vertically offset to the rear of said top wall and away from said one face so that the lifting of said hook relative to the hanger causes the apex of the hook to pass to the rear of the hanger thereby to prevent inadvertent disengagement thereof.

2. The drapery hanger of claim 1 wherein a finger cooperates with a wall of the eye to form a restricted passage for the passage of the hook during the insertion thereof.

3. The drapery hanger of claim 2 wherein said finger is cantilever mounted from one side wall of the eye.

4. The drapery hanger of claim 2 wherein the wall of said eye adjacent the free end of said finger comprises offset vertically disposed portions to provide a shoulder cooperating with the end of said finger to form said restricted neck.

5. The drapery hanger of claim 2 wherein the supporting surface has an apex and the ends of said finger straddle the apex of the supporting surface.

6. The drapery hanger of claim 2 wherein the lower side of said finger is angled upwardly from said restricted passage to guide the hook away from said passage when the hook is lifted relative to the hanger.

7. A traverse rod having a slotted back wall, a drapery hanger including a slide mounted in the slot of said back wall for longitudinal movement therealong and a pendant secured to said slide, said pendant including a forwardly bent intermediate depending section and a depending lower section, said lower section providing an eye which extends into said intermediate section to facilitate the threading of an end of a drapery hook therein, a laterally projecting finger extending laterally across said eye, the bottom wall of said eye forming a supporting surface for said hook and being generally V-shaped to cause the hook to reset in the apex thereof, the bottom wall of said finger extending across the apex of said supporting surface and being angled upwardly to its juncture with the side wall of the eye.

8. The device of claim 7 wherein said apex of said bottom wall is disposed substantially along the vertical centerline of said pendant.

* * * * *